United States Patent [19]

Robert-Grandpierre

[11] 4,128,991

[45] Dec. 12, 1978

[54] ELECTRONIC DIGITAL WATCH

[75] Inventor: Jean-Claude Robert-Grandpierre, Colombier, Switzerland

[73] Assignee: Ebauches SA, Neuchatel, Switzerland

[21] Appl. No.: 752,430

[22] Filed: Dec. 20, 1976

[30] Foreign Application Priority Data

Jan. 12, 1976 [CH] Switzerland ..... 263/76

[51] Int. Cl.[2] ..... G04C 3/00

[52] U.S. Cl. ..... 58/23 R; 58/85.5

[58] Field of Search ..... 58/23 R, 57, 85.5

[56] References Cited

U.S. PATENT DOCUMENTS

| | | | |
|---|---|---|---|
| 3,871,168 | 3/1975 | Maire | 58/23 R |
| 3,988,597 | 10/1976 | Yamaguchi | 58/23 R |

*Primary Examiner*—Robert K. Schaefer
*Assistant Examiner*—Leonard W. Pojunas, Jr.
*Attorney, Agent, or Firm*—Imirie, Smiley & Guay

[57] ABSTRACT

An electronic digital watch including a device for enabling the correction of the minutes and seconds display. The device includes a delay circuit which only enables a correction to be effected if the push-button for correcting the display is actuated for a predetermined time, and means for resetting the seconds display to zero and, if the watch is slow, advancing the minutes display by one.

4 Claims, 2 Drawing Figures

ELECTRONIC DIGITAL WATCH

The present invention concerns a digital electronic watch comprising a quartz oscillator, a frequency divider chain, counters and display circuits for the hours, minutes and seconds, and a device for correcting the time displayed.

The setting of an electronic quartz watch is generally a rather long and tedious operation. If, for example, the watch shows the date, the hour, the minute and the second, it is necessary first of all to set the counters for the date and the hours to the correct value, then to adjust the counter of the minutes at a time greater by one unit than the actual time, finally, to stop the watch, set the counter of the seconds at zero and to start the watch again at a signal indicating the start of a minute.

The object of the present invention is a digital electronic watch comprising a system for setting the time of the minutes and seconds which simplifies this operation when the difference between the time indicated by the watch and actual time is not more than plus or minus 30 seconds, which is generally the case. Quartz electronic watches are in fact so precise that it usually takes several months for the difference to reach this value. Furthermore, the system prevents any unintentional setting of the watch.

According to the present invention there is provided an electronic digital watch comprising a quartz crystal oscillator, a divider chain, counters and circuits for displaying hours, minutes and seconds, and a device for correcting the time displayed, the device for correcting the minutes and seconds comprising, a retarding device capable of being engaged at a signal for setting the watch to the correct time by actuating a push button, the said retarding device delivering a signal only if the said push button is actuated until the end of the retarding operation, the said signal acting by way of a logic device on the seconds counter to put it into a state corresponding to the time at the end of the retarding operation, and a decoder for controlling a gate according to the state of the seconds counter just before the correction thereof, to furnish, in the event of the watch being slow, a pulse to the minutes counter.

The present invention will be described further, by way of example, with reference to the accompanying drawings, in which.

Figure 1:
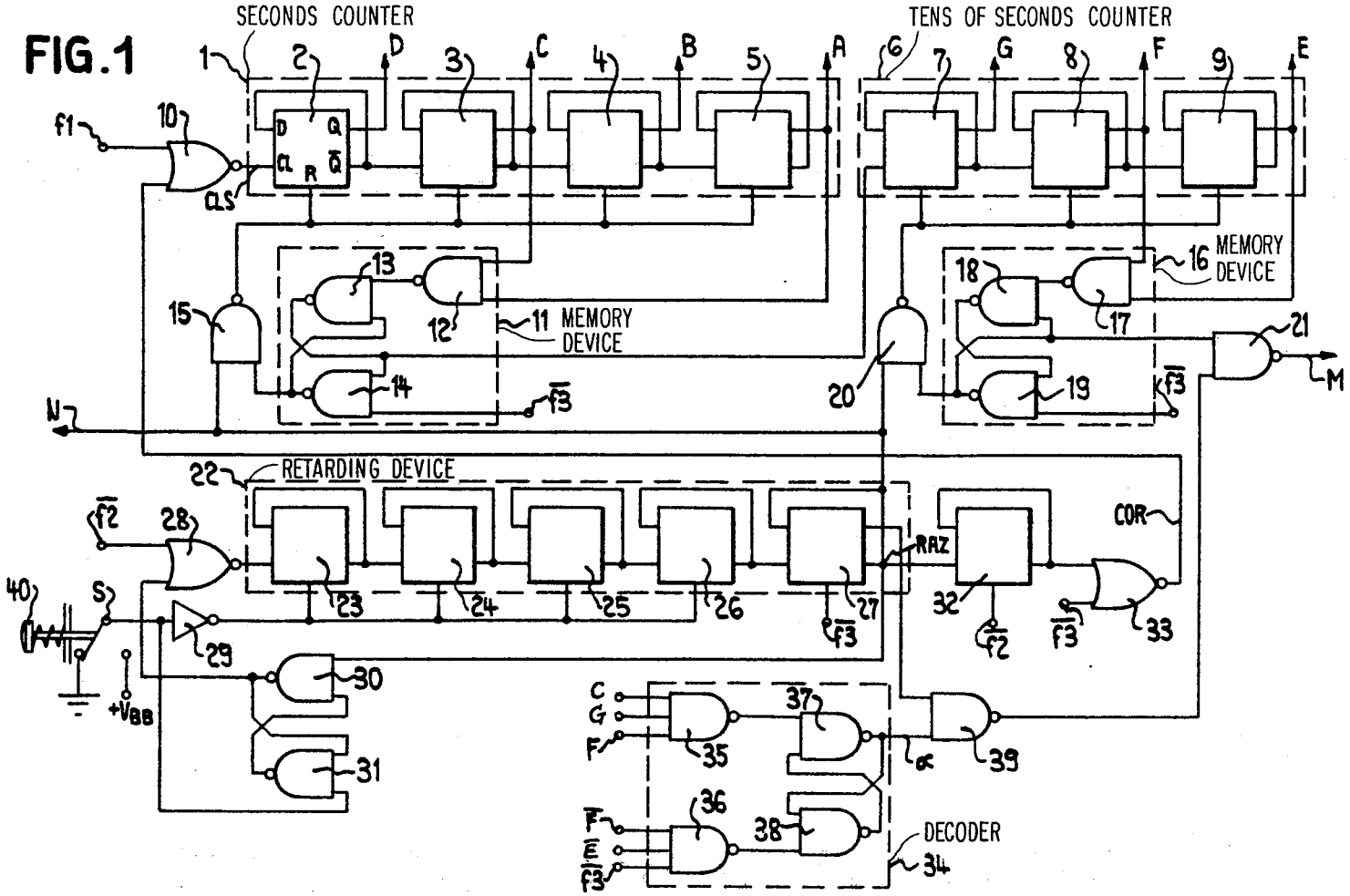
FIG. 1 shows a block diagram of a watch according to the invention.

With reference to FIG. 1, a seconds counter 1 is supplied with a pulse train f1 of frequency 1 Hz via a NOR gate 10. The pulse train is supplied by a quartz oscillator, not shown, via a chain of dividers, also not shown. The seconds counter 1 is composed of four D flip-flops 2 to 5. The input symbols (D, CL, R) and output symbols (Q, $\overline{Q}$) are shown only on the flip-flop 2, but the arrangement of these inputs and outputs remains the same for all the D flip-flops.

The Q output of each flip-flop 2 to 5 presents a bit of the binary coded information of the seconds units (A, B, C, D). The counter 1 having only to count from 0 to 9, all its flip-flops are returned to zero as soon as the outputs A to D present the number 10 in binary code, i.e. 1010.

This return to zero is effected by means of a device 11 composed of a NAND gate 12 detecting the presence of logic "1" at the outputs B and D and changing over a memory 13, 14 which receives on its second input a train of pulses $\overline{f3}$ issuing from the chain of dividers (not shown). The frequency of this pulse train (32 Hz for example) is such that the signal for return to zero, which passes through a NAND gate 15, is short.

The device 11 also provides the pulses for a tens of seconds counter 6 comprising three D flip-flops 7 to 9. The outputs E, F and G of these flip-flops present the information, in binary code, of the tens of seconds. Since this counter 6 has to count only from 0 to 5, its flip-flops are returned to zero in a manner similar to that described in the case of the counter 1 by a device 16 composed of a NAND gate 17 which detects the presence of the number 6 (in binary: 110), and of the memory 18, 19. The signal for return to zero is applied to the flip-flops 7 to 9 via a NAND gate 20. The memory 18, 19 also supplies pulses M intended to feed, via a NAND gate 21 the minutes counter (not shown).

A retarding device or time delay circuit 22, composed of the D flip-flops 23 to 27 is fed through a NOR gate 28 by a train of pulses $\overline{f2}$ of frequency 8 Hz, issuing from the divider chain. The flip-flops 23 to 26 are kept at zero, in normal operation, by a signal "1" furnished by the output of an inverter 29, the input of which is itself kept at "0" by the fact that a push button 40, controlling the setting of the watch, is in the rest position. The flip-flop 27 receives the pulse train $\overline{f3}$ at its reset input. The output $\overline{Q}$ of flip-flop 27 is connected to the reset inputs of the flip-flops of the counters 1 and 6 via the NAND gates 15, and 20, respectively. The output $\overline{Q}$ is also connected to an input of a memory 30, 31, the second input of which is connected to the input of the inverter 29, and an input of a D flip-flop 32, the input R of which receives the pulse train $\overline{f2}$. The output $\overline{Q}$ is also connected (arrow N) to the reset inputs of some of the flip-flops of the divider chain (not shown), more precisely, of the flip-flops located between the one which furnishes the pulse train $\overline{f3}$ and the end of the divider chain. The output of the memory 30, 31 controls a NOR gate 28, whilst the output $\overline{Q}$ of the D flip-flop 32 controls a NOR gate 33 which receives the pulse train $\overline{f3}$ on its second input. The output of the gate 33 is connected, by way of the NOR gate 10 to the input of the seconds units counter 1.

The device also comprises a decoder 34 having two NAND gates 35 and 36 and a memory 37, 38. The gate 35 receives the information C, F, G of the seconds counter, and the gate 36 receives the inverse of the information F and E, that is to say, $\overline{F}$ and $\overline{E}$, as also the pulse train $\overline{f3}$. The gates 35 and 36 each feed one of the inputs of the memory 37, 38, so that the output of the decoder presents a signal $\alpha$ which is in the "0" state when the seconds counter 1, 6 indicates a value between 0 and 32 seconds, and the "1" state the remainder of the time. The signal $\alpha$ controls a NAND gate 39, the second input of which is connected to the Q output of the flip-flop 27. The output of the gate 39 is connected, via the NAND gate 21, to the input of the minutes counter (not shown).

Figure 2:
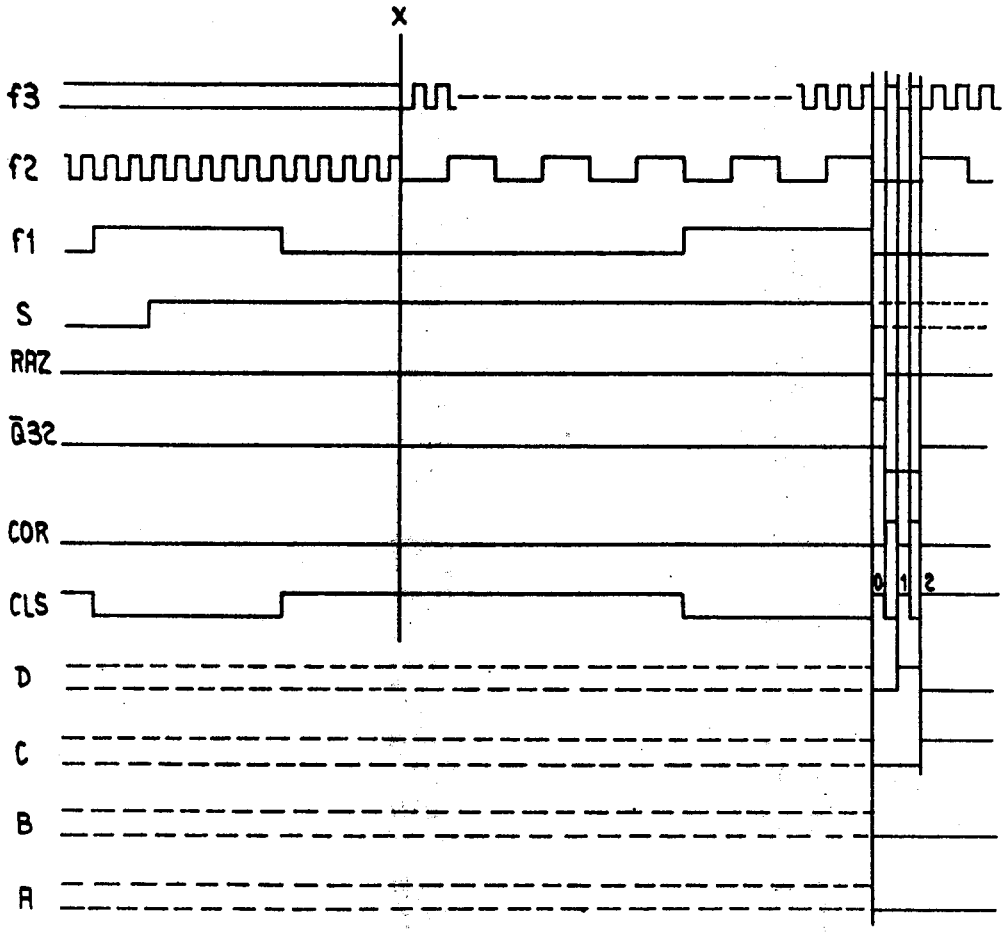
FIG. 2 illustrates the operation of the watch shown in FIG. 1.

We shall describe the operation of the watch with reference to FIG. 2 showing the pulse trains f3 (32 Hz), f2 (8 Hz) and f1 (1 Hz), and some other signals. The time scale is not constant in FIG. 2; from the point marked X, it is magnified to permit easier reading.

When it is desired to set the time of the watch, a user presses the push button 40 at a precise moment indicated by a time signal at the start of a minute. This provides a signal "1" at the input of the inverter 29 (signal S) and thus a "0" at its output. The counter 22, not being kept at zero, begins to count the pulses $\overline{f2}$. Two seconds later, if the pressure has been sustained on the push button 40 for this time, the D flip-flop 27 changes over and its output (signal RAZ), which is now a "1", zeros counters 1, 6; the preceding divider stages; and changes over the memory 30, 31. The output of the latter then blocks the NOR gate 28, interrupting the arrival of the pulses $\overline{f2}$ at the input of the counter 22. The D flip-flop 27 is returned to its previous state by a pulse $\overline{f3}$ approximately 15 ms after having switched. It then changesover the D flip-flop 32, the output of which opens the NOR gate 33 until it is returned to zero by a pulse $\overline{f2}$. Two pulses COR, furnished by the pulse train $\overline{f3}$, pass through the gate 33 whilst it is open. The input CL of the D flip-flop 2 then receives two pulses marked 1 and 2 (signal CLS) just after it has been returned to zero. The pulse marked O has no influence, for it is produced at the same time as the pulse RAZ, the effect of which is predominant since the reset input of a D flip-flop overrides the clock input.

If, at the moment of the pulse RAZ, the signal $\alpha$ is in the state "1" that is to say, if the seconds counters 1 and 6 indicate, just before they are returned to zero a value between 32 and 0 seconds, a pulse is transmitted by the Q output of the flip-flop 27, through the NAND gates 39 and 21, to the minutes counter which advances by one unit. The fact that the signal $\alpha$ is at "1" at that instant, indicates in fact that the watch is slow, and the correction of the state of the seconds counter should be accompanied by an advance of the minutes counter.

If, at the moment of the pulse RAZ, the signal $\alpha$ is in the state "0" i.e. if the seconds counters indicate a value between 0 and 32 seconds, this means that the watch is fast; the minutes counter receives no pulses, for the NAND gate 39 is then blocked. The setting of the watch is limited to a correction of the state of the seconds counter.

This setting of the watch cannot take place accidentally, for if the pressure on the push button does not last as long as the retarding operation, the flip-flops 23 to 27 are immediately returned to zero and nothing happens.

It is evident that other values could have been selected for the frequency of the pulse trains f2 and f3. Similarly, the duration of the retarding operation could be different. But then it would have been necessary to connect the decoder in such manner that, if T is the duration of the retarding operation, its output should be in the state "0" when the seconds counter indicates a value between 0 and (30 + T) seconds, and that it is in the state "1" when this value is between (30 + T) and 0 seconds.

I claim:

1. An electronic digital watch comprising a quartz crystal oscillator, a divider chain, counters and circuits for displaying hours, minutes and seconds, and a means for correcting the counters for the minutes and seconds when the difference between the indicated time and the actual time is not more than plus or minus 30 seconds, said correcting means comprising, a push button, a first logic circuit, a time delay circuit which is activated by the operation of said push button and which produces an output signal only if the said push button is actuated until the end of the time delay period, the said output signal being delivered via said first logic circuit to the seconds counters to put said seconds counters into a state corresponding to the actual time at the end of said time delay operation, and a second logic circuit for determining when the watch is slow and for delivering a correcting pulse to the minutes counter, the outputs of said seconds counters being inputted to said second logic circuit, said second logic circuit delivering said correcting pulse to the minutes counter at the end of the time delay operation.

2. An electronic watch according to claim 1, in which the time delay circuit is a counter which comprises a plurality of stages, the first of which is kept at zero whilst the push button is in a rest position, and the last of which is returned to zero by a first train of pulses issuing from the divider chain, said counter being fed, via a second gate, by a second train of pulses also issuing from the divider chain, when the push button is actuated, the output signal of the said last stage acting, at the end of the time delay operation, on a memory to close the said second gate.

3. An electronic watch according to claim 2, in which the output signal of the last stage of the time delay circuit returns the seconds counters and part of the divider chain to zero, and changes over a flip-flop controlling a third gate, said flip-flop and said third gate forming the said first logic circuit, the said flip-flop remaining in its changed-over state long enough for the said third gate to allow as many pulses to pass as the number of seconds that the time delay operation lasts, these pulses being furnished by the said first pulse train, and said flip-flop being returned to zero by the said second train of pulses.

4. An electronic watch according to claim 1, in which the said second logic circuit comprises a decoder, a first gate and a second gate, the said first gate receiving on one of its inputs the output of said decoder, and on its other input the output signal of the time delay circuit, the said first gate being opened by the said decoder during the time in which the seconds counters indicate a value between (30 + T) and 0 seconds, and being closed for the rest of the time, T being a whole number between 0 and 30 so that the minutes counter receives, through the second gate which is opened by the output signal from said first gate, at the end of the time delay operation, a pulse which advances it by 1 minute, only if the watch is slow.

* * * * *